US006828516B1

(12) United States Patent
Han

(10) Patent No.: US 6,828,516 B1
(45) Date of Patent: Dec. 7, 2004

(54) SEMI-ELASTIC SWITCH COVERING DEVICE FOR AN ELECTRICAL SYSTEM HAVING AN EXTERNAL CONTROL PANEL AND CONTROL APPARATUS FOR AN ELECTRONIC MACHINE

(75) Inventor: Sang-Hyun Han, Kyungki-do (KR)

(73) Assignee: Samsung Electronics, Co., Ltd., Suwon-si (KR)

( * ) Notice: Subject to any disclaimer, the term of this patent is extended or adjusted under 35 U.S.C. 154(b) by 711 days.

(21) Appl. No.: 09/337,492

(22) Filed: Jun. 22, 1999

Related U.S. Application Data

(63) Continuation-in-part of application No. 08/946,787, filed on Oct. 8, 1997, now abandoned.

(30) Foreign Application Priority Data

Oct. 8, 1996 (KR) ..... 96-44656

(51) Int. Cl.[7] ..... H01H 9/00
(52) U.S. Cl. ..... 200/5 A; 200/330; 200/343
(58) Field of Search ..... 200/5 A, 517, 200/330, 343, 302.2, 561, 339, 521, 342, 5 R, 6 A; 400/490, 495

(56) References Cited

U.S. PATENT DOCUMENTS 3,982,081 A 9/1976 Demler, Jr. ..... 200/5 A
4,559,427 A 12/1985 Dolson et al. ..... 200/343 X
4,778,952 A * 10/1988 Watkins et al. ..... 200/5 A
4,859,820 A * 8/1989 Gotfryd et al. ..... 200/517 X
5,347,427 A 9/1994 Kinoshita
5,363,150 A 11/1994 Kojima
5,422,447 A 6/1995 Spence ..... 200/5 A
5,623,393 A 4/1997 Yau
5,763,841 A 6/1998 Hasunuma ..... 200/5 A

* cited by examiner

*Primary Examiner*—Renee Luebke
(74) *Attorney, Agent, or Firm*—Robert E. Bushnell, Esq.

(57) ABSTRACT

A control apparatus uses an intermediate device in combination with buttons and tactile pressure switches to carry out functions of an electrical system. The intermediate device increases the reliability of the control panel and avoids problems occurring from repetitive use. The device is also easily adjustable to correct dimensional tolerance problems that occur during manufacturing or use. In one embodiment, the intermediate device comprises a switch covering device in the form of a semi-elastic switch structure attached to the main board or frame of the electrical system by a plurality of connectors, flexible supports and latching members. In a second embodiment, the intermediate device comprises a gap-maintaining member fixed to the frame and latched to the main board, and having a plurality of the elastic tactile members located between protrusions and tactile switches. In each embodiment, constant gaps are maintained between various pairs of elements of the control apparatus.

30 Claims, 4 Drawing Sheets

SEMI-ELASTIC SWITCH COVERING DEVICE FOR AN ELECTRICAL SYSTEM HAVING AN EXTERNAL CONTROL PANEL AND CONTROL APPARATUS FOR AN ELECTRONIC MACHINE

CLAIM OF PRIORITY

This application makes reference to, and claims all benefits accruing under 35 U.S.C. §119 from my application entitled Tactile Switch Structure for Use in Electrical System Having External Control Panel earlier filed in the Korean Industrial Property Office on the 8th day of October 1996, and there duly assigned Ser. No. 96-44656 by that Office.

REFERENCE TO RELATED APPLICATION

This is a continuation-in-part (CIP) of Ser. No. 08/946,787 filed on Oct. 8, 1997, and now abandon and assigned to the assignee of the present invention.

BACKGROUND OF THE INVENTION

1. Field of the Invention

The present invention relates to a switch covering device and, in particular, to a semi-elastic switch covering device for use in an electrical system such as a display monitor having an external control panel. More specifically, the invention relates to a control apparatus in which malfunction is prevented by locating a gap-maintaining member between a control knob and a tactile switch so as to maintain a constant gap between the control knob and the tactile switch when the control knob is not being activated.

2. Background Art

Many electrical systems, e.g., a display monitor, television, or printer, make use of an external control panel to allow the user to manipulate the various functions made available by the electrical system. Typically, these control panels are positioned opposite from pressure switches that are installed inside the outer housing of the electrical system and activated by the indirect contact of a button installed in the outer housing. The pressure switch is mounted on a main board and aligned with an external control button so that a user activates the switch by pressing on the button. Examples of this are shown in U.S. Pat. No. 5,363,150 to Kojima entitled Casing for a Television Set, U.S. Pat. No. 5,623,393 to Yau entitled Monitor Control Panel Mounting Structure, and U.S. Pat. No. 5,347,427 to Kinoshita entitled Cabinet Assembly.

Furthermore, some electrical systems use spacers to support the main board and maintain the required design distance between the outer control button and the pressure switch. I have observed that these spacers create tolerance problems due to naturally occurring deformations in the panel due to cyclic stresses that accumulate with frequent use over time and manufacturing variations in the assembled components. When the actual distance between the outer control button and the pressure switch is greater than the design distance the user may experience difficulty in activating the pressure switch by pressing the button. When the actual distance is less than the design distance the user may find that the pressure switch is continuously activated or activated too easily. I expect that an intermediary device that could maintain the constant design spacing would increase that reliability of and simplify the manufacture of control panels for typical electrical systems.

Thus, in prior arrangements, a gap between a control button or knob and a pressure or tactile switch varies in dependence on the deformation of the apparatus and on the variation in the manufacturing tolerance limit of the apparatus. This variation in the gap between the control button or knob and the pressure or tactile switch causes the switch to malfunction due to inadvertent contact between the button or knob and the switch without any action on the part of the user. Therefore, there is a need in the prior art for the development of a control apparatus having some means or technique for maintaining a constant gap between a control button or knob and a pressure or tactile switch.

SUMMARY OF THE INVENTION

Accordingly, it is an object of the present invention to provide a switch covering device that is positioned between a switch and a control button.

It is another object to provide a switch covering device that improves the performance of the control panel.

It is still another object to provide a switch covering device that enhances the system reliability of a control panel by preventing malfunctions due to deformations resulting from cyclic stress from repetitive use.

It is yet another object to provide a switch covering device that can compensate for inherent physical tolerances of various components of the electrical system and housing.

It is still yet another object to provide a switch covering device that maintains a precise interval between the pressure switch and the associated member that activates the switch.

It is a further object to provide a switch covering device that can be adjusted to compensate for deformations of system components that occur over time.

It is a further object to provide a control apparatus in which there is a constant gap between a control button or knob and a pressure or tactile switch.

It is a further object to provide a control apparatus in which variation in the gap between the control button or knob and the pressure or tactile switch is prevented.

It is a still further object to provide a control apparatus having a gap-maintaining member disposed between a control knob or button and a pressure or tactile switch.

To achieve these and other objects, in a first embodiment of the invention, a semi-elastic switch structure is attached to the frame of an electrical system between a pressure switch and the external control panel. This structure may be constructed of a basically rigid material except for the switch covers that are constructed of an elastic material that allows the covers to be depressed by a button and brought into contact with a pressure switch. This semi-elastic switch structure covers the pressure switches and may be attached to the main board or frame of the electrical system by a plurality of connectors, flexible supports, and latching members. The main board supports and connects the pressure switches to the electrical system.

This semi-elastic switch structure creates a third potential space, other than the constant space between the control button and the switch cover and the constant space between the switch cover and the pressure switch. This extra space can be formed between the underside of the latching members and the frame. This enables the constant space between the button and the switch cover and the constant space between the switch cover and the pressure switch to be adjusted to compensate for tolerance errors in the manufacture of other components during the manufacturing process or the deformation of components due to repetitive use.

To further achieve the above and other objects of the invention, in a second embodiment of the invention, a control apparatus for an electronic machine comprises: a case having a knob hole; a control knob disposed in the knob hole and having a plurality of bosses; a gap-maintaining member having a plurality of latches corresponding to a plurality of latch holes in a main board and a plurality of elastic tactile members corresponding to protrusions; and a main board including a plurality of tactile switches engaged with corresponding elastic tactile members.

Furthermore, in the second embodiment of the invention, the main board is located on an is opposite side of the knob relative to the gap-maintaining member. A plurality of main board holders for latching the main board to the gap-maintaining member is provided. The gap-maintaining member is attached to a frame inside the electronic machine by latching a latch of the gap-maintaining member into a latch hole formed on a frame. The tactile switch is disposed on the main board, which is attached to the gap-maintaining member, and maintains a constant gap between the tactile switch and the elastic tactile member of the gap-maintaining member. The elastic tactile member maintains a second gap between the protrusion of the knob and the elastic tactile member constant.

BRIEF DESCRIPTION OF THE ATTACHED DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENT

Figure 1:
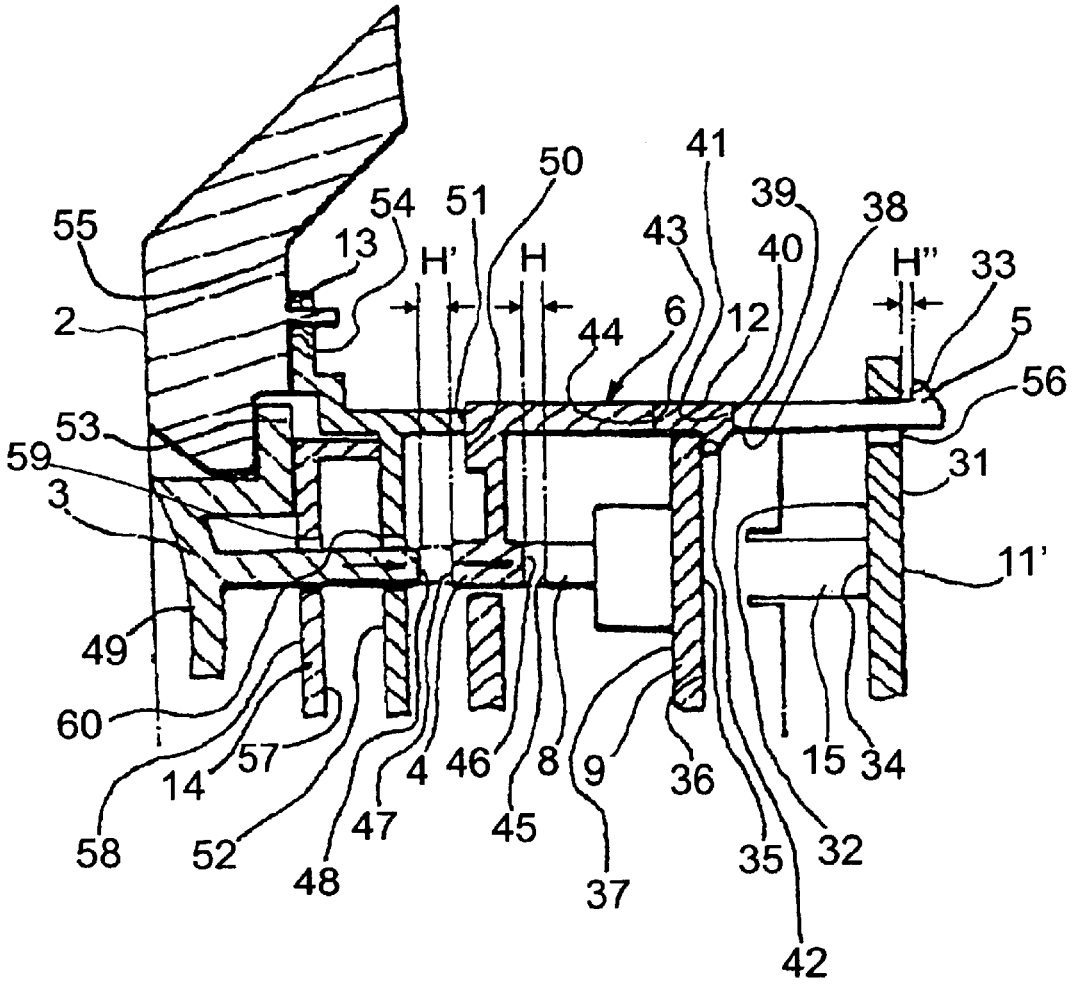
FIG. 1 is a cross-sectional side view of the operative elements of the semi-elastic switch covering device incorporated into an electrical system and attached between a control panel and the associated pressure switches in accordance with a first embodiment of the invention.

The first embodiment of a semi-elastic switch covering device used in a monitor or television is shown in FIG. 1. Pressure switches (only one is shown) 8 are mounted on side 37 of main board 9. The pressure switches 8 are connected to an electrical system to allow various functions of the system to be altered. When surface 49 of control button 3 is depressed, surface 48 of the button 3 contacts surface 47 of the switch cover 4. This causes surface 46 of the switch cover 4 to contact surface 45 of pressure switch 8 and to activate the switch 8. Semi-elastic switch cover or structure 6 is installed behind control or front panel 2 and is in direct line with both control button 3 and pressure switch 8. The switch cover 6 is braced by a combination of flexible supports 15 and latching members 5. The latching members 5 are inserted through holes 56 (only one is shown) in frame 11' and surface 33 of latching members 5 engages surface 31 of frame 11'. This prevents the semi-elastic switch structure 6 from moving away from frame 11'. Flexible supports 15 (only one is shown) brace the switch structure 6 in place by abutting surface 34 of flexible supports 15 against surface 32 of frame 11'. Once switch structure 6 is braced, an interval H is formed between surface 46 of switch cover 4 and surface 45 of pressure switch 8.

The main board 9 is fixed in switch structure 6 by connectors located on the inner surface of switch structure 6. Surface 42 of connector 12 snaps into place to engage surface 35 of main board 9. Thus, main board 9 is fixed with respect to frame 11'. This creates a first is established interval H between switch cover 4 and pressure switch 8. A second interval H' between switch cover 4 and control button 3. Interval H' starts as being of a certain value but slowly degrades due to cyclical stresses from repetitive use or, in some cases the interval is inaccurate from the time of assembly due to dimensional errors in the individual components of the device. However, as detailed herein, deviations due to dimensional errors or repetitive use can be easily corrected. The switch structure 6 is fixed relative to the frame 11' and control button 3 is mounted on the front panel 2, thus fixing the distance between the switch structure 6 and the control button 3. Surface 51 of guide frame 13 is supported by front panel 2 and abuts surface 50 of the switch structure 6. Rubber bumper 14 is supported by a combination of control button 3 and guide frame 13. Surface 54 of the guide frame 13 contacts surface 55 of front panel 2, and surface 53 of control button 3 contacts surface 58 of rubber bumper 14.

The above structure causes interval H, located between switch cover 4 and pressure switch 8, to be of a certain value. Furthermore, semi-elastic switch cover 6 is attached to frame 11' and guide frame 13 is attached to front panel 2, thus forming a second interval H'. Should there be a slight discrepancy in the intended spacing of intervals H and H' after initial assembly, they can be corrected by adjusting the space between surface 33 of latching members 5 and surface 31 of frame 11. This additional interval is labeled H" in FIG. 1. This is possible because the flexibility of the flexible supports 15 allows for the position of switch structure 6 to be adjusted. As such, the intervals H and H' can be precisely controlled by altering the surplus interval H'. The ability to adjust intervals H and H' helps prevent the malfunction of pressure switch 8.

Figure 2:
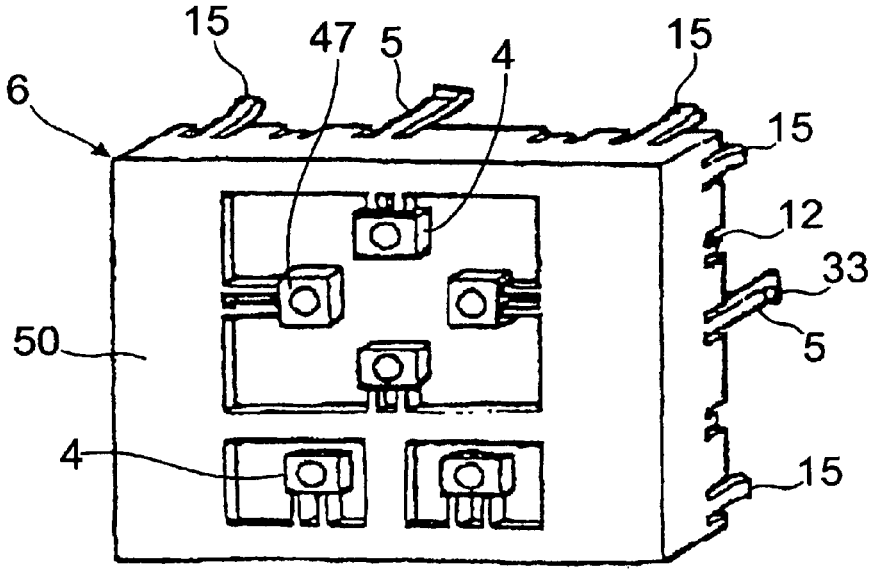
FIG. 2 is a perspective view of the semi-elastic switch covering device of FIG. 2 constructed as a preferred embodiment according to the principles of the first embodiment of the present invention.

A semi-elastic switch structure constructed as a preferred embodiment according to the principles of the first embodiment of the present invention is shown separately from any other components in FIG. 2. This switch structure 6 can be adapted to accommodate any switch configuration, by adopting or removing a plurality of switch covers 4. In this example, shown in FIG. 1, the switch structure 6 is incorporated into a monitor or television to control horizontal and vertical gain, horizontal and vertical position, and to increase or decrease the magnitude of the aforementioned controls.

I expect that this semi-elastic switch cover 6 will help prevent the malfunction of a combination external control button 3 and pressure switch 8, will enhance the electrical system performance, and will increase the reliability of control panels 2 that use the combination of a control button 3 and a pressure switch 8.

Figure 3:
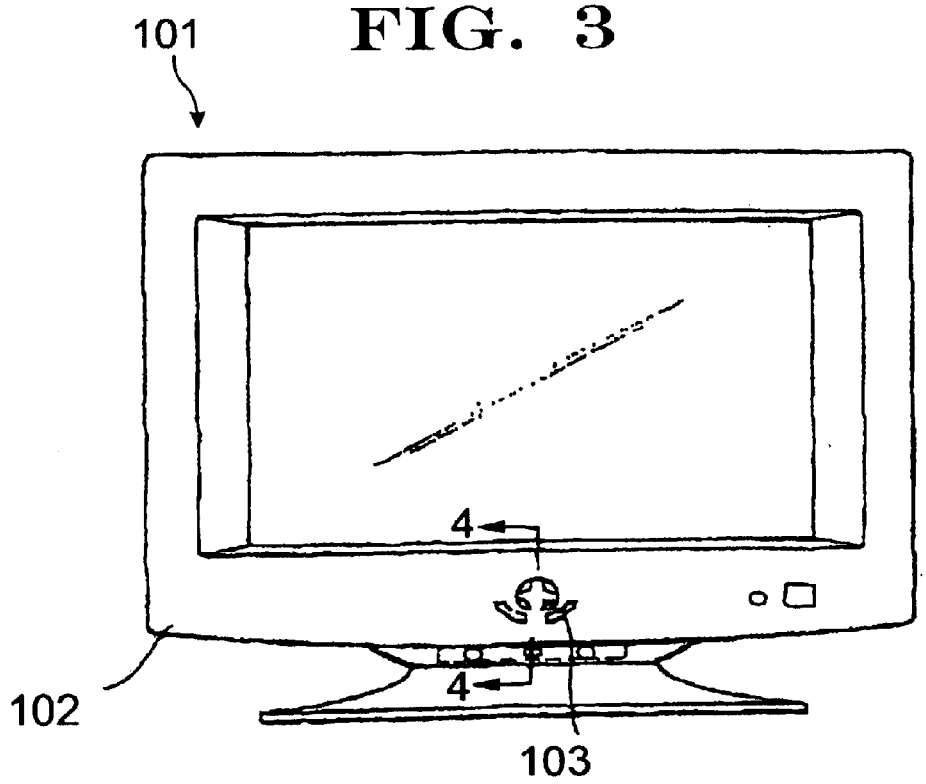
FIG. 3 is a front view of a monitor in which the present invention can be utilized.

Further considering the drawings in conjunction with a description of the second embodiment of the invention, FIG. 3 is a front view of a monitor in which the present invention can be utilized. As seen in FIG. 3, the monitor 101 basically comprises a case 102 and a control knob 103.

Figure 4:
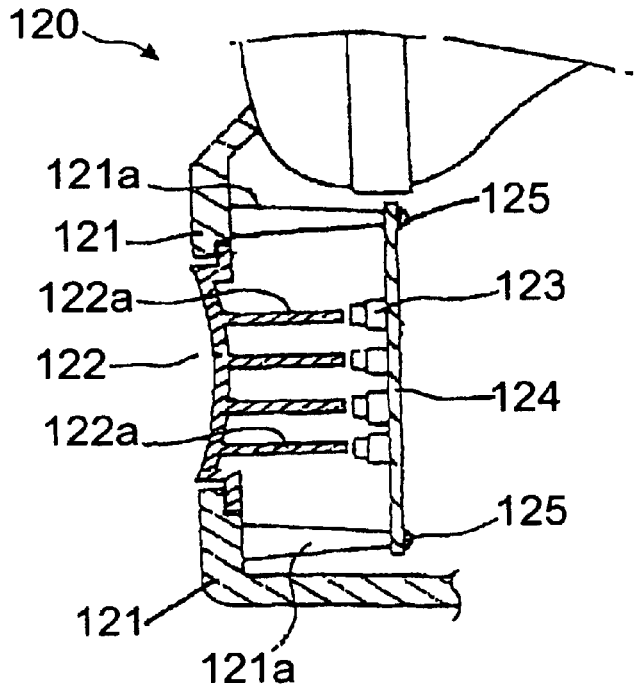
FIG. 4 is a cross-sectional view of a control apparatus taken along line 4—4 of FIG. 3.

FIG. 4 is a cross-sectional view, taken a long line 4—4 of FIG. 3, of a control apparatus employed in the monitor of FIG. 3. As seen in FIG. 4, a pressure or tactile switch assembly 120 includes a front panel portion 121 and a control knob 122 provided with spacers 122*a* which extend toward pressure switches 123 located on a main board 124. Bosses 121*a* extend between and interconnect a lower portion of the frame 121 with the main board 124, the spacers 121*a* being connected to the main board 124 by means of screws or other fastening devices 125.

In general, it should be noted that, in such electronic machines, a control panel is usually positioned on an outer surface of the electronic machine (for example, a monitor), and a main circuit board is attached to an inside of the control panel. A knob is formed on the control panel, and the user pushes the knob to operate the machine.

Referring now to FIGS. 3 and 4, control knob 122 is attached to the front case 121 instead of to the front panel. Front case 121 is positioned on the front of the electronic machine (e.g., monitor). Control knob 122 is attached to the front case 121, and bosses 121*a* are formed on the inside of the front case 121. Board 124 is fixed to the bosses 121*a* by means of screws 125, and has tactile switches 123 mounted thereon. A plurality of protrusions 122*a* are formed on the interior of the control knob 122, and come into contact with the tactile switches 123 when the control knob 122 is depressed by the user. The gap between protrusions 122*a* of control knob 122 and tactile switches 123 is, preferably, maintained in the arrange of 0.2–0.3 mm for the purpose of normal operation. Tolerance problems due to deformation of the main board 124 and bosses 121*a* during use of the control knob 122 are inherently created. Moreover, such tolerance problems also can result from production or manufacture of the apparatus.

Therefore, when the main board 124 is fixed to the bosses 121*a*, the gap between protrusions 122*a* and switches 123 is not maintained constant, and therefore control knob 122 is not exactly engaged in contact with tactile switches 123 because the gap between, and positioning of, the knob 122 and the switches 123 varies. If the size of the bosses 121*a* is made larger, the knob 122 does not reach the tactile switches 123 because the gap between the knob 122 and the switches 123 becomes excessively large. Conversely, if the size of the bosses 121*a* is made small, the knob 122 is in unintended contact with the tactile switches 123, and this causes malfunctioning because the gap between the knob 122 and the tactile switches 123 is too small.

Figure 5:
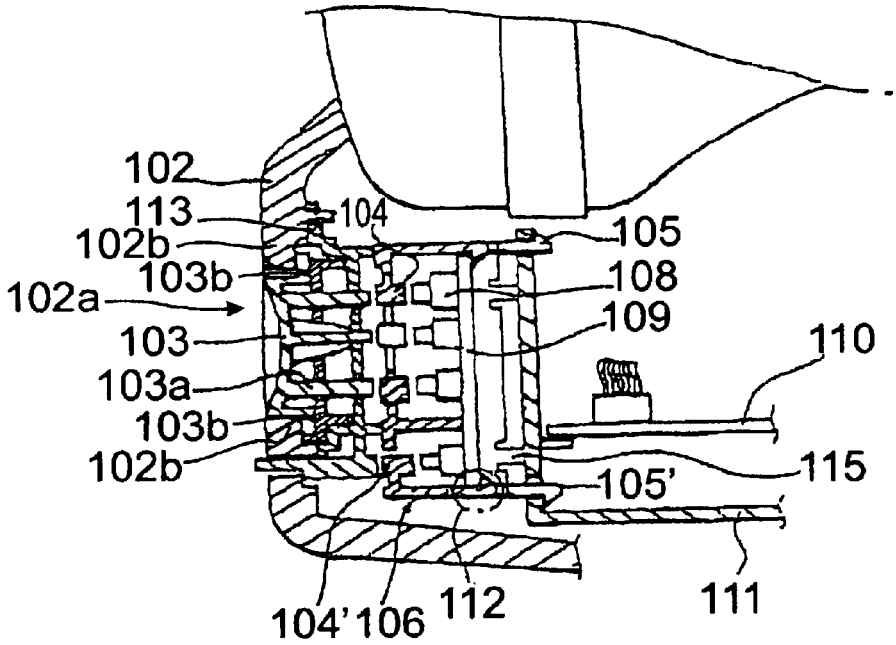
FIG. 5 is a cross-sectional view of a control apparatus in accordance with a second embodiment of the present invention.

FIG. 5 is a cross-sectional view of a control apparatus constructed in accordance with a second embodiment of the present invention. As seen in FIG. 5, the control apparatus comprises a case 102 in which a hole 102*a* is formed for receiving a control knob 103. Guide latches 102*b* are formed on the inside of the case 102 so that, when control knob 103 is inserted into knob hole 102*a*, control knob 103 is latched into and fixed on the guide latches 102*b* of the case 102.

Further considering FIG. 5, a main circuit board 110 is fixed onto frame 111, while gap-maintaining member 106 is latched onto frame 111, which is used for fixing other electronic components.

Control knob 103 is used by a user to control the electronic apparatus by exerting pressure on the control knob 103. The outer surface of the control knob 103 is exposed through the knob hole 102*a*. At the same time, a latch or latches 103*b* of the control knob 103 is fixed onto guide latches 102*b* of case 102. In addition, a plurality of protrusions 103*a* are formed on the interior surface of the control knob 103.

Furthermore, a plurality of tactile switches 108 is disposed on the main board 109, which is fixed onto the gap-maintaining member 106 at the portion 112 (circled in FIG. 5) of the arrangement. A plurality of latch members 105 and 105', a plurality of flexible supporters 115, and a plurality of board holders (snap-type) 112 are formed on the gap-maintaining member 106. The latch members 105 and 105' are inserted into a latch holder (not shown) in order to fix the gap-maintaining member 106 to frame 111. Flexible supporters 115 are used for supporting the gap-maintaining member 106 in connective relationship to frame 111. Board holders 112 are used for fixing main board 109 to the interior of gap-maintaining member 106.

Further considering FIG. 5, a plurality of elastic tactile members 104 and 104' is formed on gap-maintaining member 106, and come into contact with corresponding protrusions 103*a* and iiu, corresponding tactile switches 108 when the knob 103 is pressed by the user. Then, protrusions 103*a* of the knob 103 depress elastic tactile members 104 which, in turn, come into contact with and depress tactile switches 108.

Figure 6:
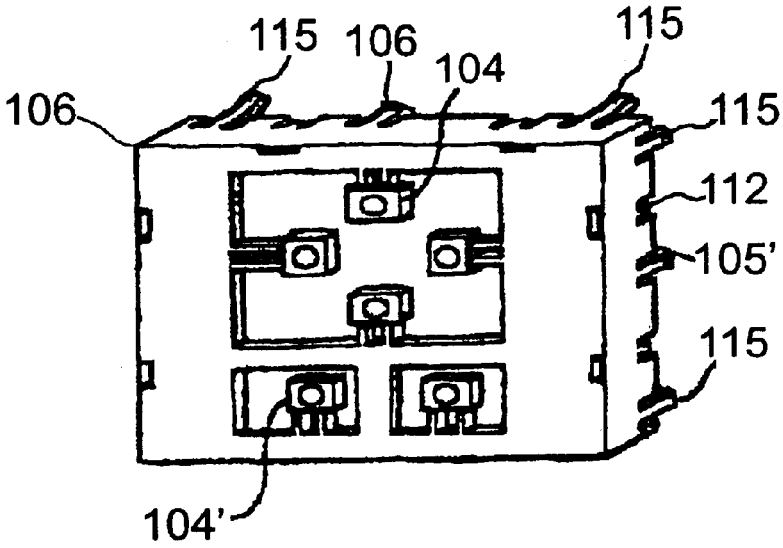
FIG. 6 is a perspective view of a gap-maintaining member shown in FIG. 5.

FIG. 6 is a perspective view of a gap-maintaining member 106 of FIG. 5. As seen in FIG. 6, and is previously discussed, gap-maintaining member 106 includes a plurality of elastic tactile members 104, latch members 105 and 105', a plurality of board holders 112, and a plurality of flexible supporters 115.

Figure 7:
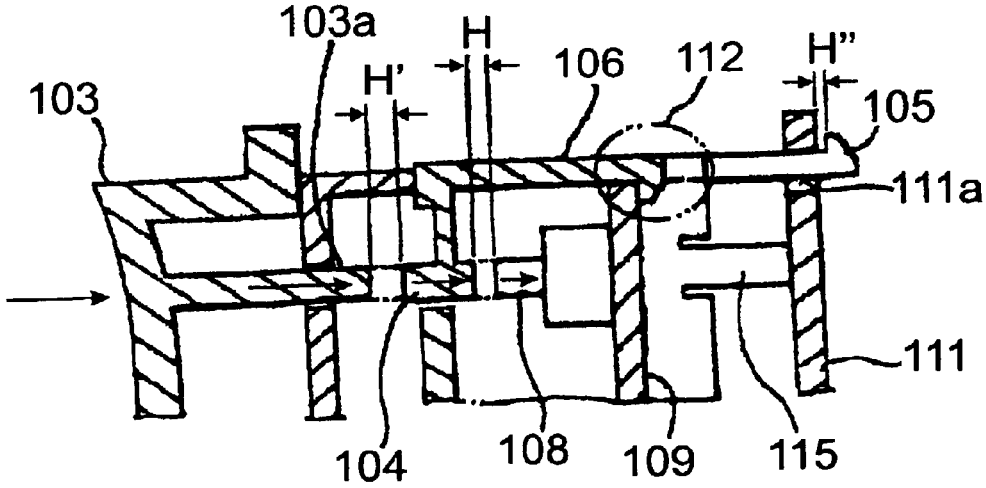
FIG. 7 is a cross-sectional view of a gap-maintaining member incorporated into the main frame and the control knob showing gaps H, H' and H".

FIG. 7 is a cross-sectional view of the gap-maintaining member 106 of FIGS. 5 and 6, as incorporated into the main frame and the control knob, with gaps H, H' and H" shown therein. As seen in FIG. 7, latch member 105 of gap-maintaining member 106 is inserted into a latch holder 111*a* of frame 111 so as to maintain a gap H" between an interior surface of latch member 105 and an opposing surface of frame 111. Elastic tactile member 104 of gap-maintaining member 106 maintains a gap H' with a protrusion 103*a* of control knob 103, and also maintains a gap H with the tactile switch 108 of main board 109.

Referring to FIGS. 5, 6 and 7, detailed operation of the control apparatus of the second embodiment of the present invention is as follows. First, control knob 103 is located in knob hole 102*a* of case 102 (FIG. 5), and is fixed onto guide latches 102*b* located on the interior of case 102. Second, main board 109 is inserted into gap-maintaining member 106, and snapped into board holder 112. Third, latch member 105 of gap-maintaining member 106 is inserted into the latch holder 111*a* of frame 111, and the gap-maintaining member 106 is fixed to frame 111.

When the control apparatus of the second embodiment of the present invention is assembled in this manner, the insertion of the latch member 105 of gap-maintaining member 106 into the latch holder 111*a* of frame 111 maintains a gap H" (FIG. 8). Elastic tactile member 104 of gap-maintaining member 106 maintains an additional gap H' with the protrusion 103*a* of knob 103, and also maintains a further gap H with tactile switch 108 of main board 109.

As a result of this embodiment of the present invention, when the user depresses the knob 103, the protrusion 103*a* depresses elastic tactile member 104 in a precise manner, and the elastic tactile member 104 in turn depresses tactile switch 108 in a precise manner. As a result, malfunctioning of the control apparatus of this embodiment of the present invention is prevented.

Although this preferred embodiment of the present invention has been disclosed for illustrative purposes, those skilled in the art will appreciate that various modifications, additions and substitutions are possible, without departing from the scope and spirit of the invention as disclosed in the accompanying claims. It is also possible that other benefits or uses of the currently disclosed invention will become apparent over time.

What is claimed is:

1. A control panel having a device for covering at least one switch operably attached to a main board supported by a frame, and having at least one control button aligned linearly with said at least one switch, said at least one switch being activatable by an external force, said device comprising:

a structure positioned operatively proximate to said at least one switch and comprising at least one supporting side and an elastic member, each said at least one switch being covered by a respective elastic member, each said respective elastic member maintaining a gap between each said at least one switch and said respective elastic member, said at least one control button being aligned linearly with said respective elastic member, said respective elastic member being depressed and activating each said at least one switch when said at least one control button is depressed;

a guide frame abutting said structure and connectable with said frame, said guide frame having a perforation accommodating said at least one control button; and a rubber bumper abutting said guide frame and having a perforation for receiving said at least one control button and being supported by a portion of said at least one control button inserted through said perforation in said rubber bumper;

said at least one control button being depressed and sliding through said perforation in said rubber bumper and said perforation in said guide frame to depress said respective elastic member and activate each said at least one switch.

2. The control panel of claim 1, said structure having four supporting sides.

3. The control panel of claim 2, said structure having a planar surface attached to said four supporting sides opposite said at least one switch, said planar surface having a plurality of perforations, each said at least one elastic member projecting inside a perimeter of a respective one of said plurality of perforations.

4. The control panel of claim 3, said planar surface having a first perforation and a second perforation, each having one elastic member, and a third perforation having four elastic members, each being aligned over a respective said at least one switch.

5. The control panel of claim 1, said structure comprising:

a plurality of members protruding from a bottom of said at least one supporting side and oriented perpendicularly to a plane of said main board, said plurality of members having a latch on an end for engaging said frame;

a plurality of flexible supports protruding from said bottom of said at least one supporting side and oriented perpendicularly to a major surface of said main board, said flexible supports abutting said frame and cooperating with said members to stabilize said structure; and a plurality of connectors positioned inside said at least one supporting side to brace said main board.

6. The control panel of claim 5, said latch on said plurality of members being disposed a first distance from a surface of said main board, said first distance being adjustable by moving said plurality of members through said frame and deforming said plurality of flexible supports.

7. The control panel of claim 6, said at least one switch being disposed a second distance from said respective elastic member, said second distance being set during assembly of the control panel;

said respective elastic member being disposed a third distance from said at least one control button, said third distance varying due to occurrence of cyclical stresses; and said second distance and said third distance being changeable by adjusting said first distance.

8. An electrical system having a device covering at least one switch, comprising:

a main board supporting said at least one switch, said main board being connected to a frame of said electrical system, said at least one switch being activated by an external force;

said device comprising a structure attached to said main board, said structure having four supporting sides and having a planar surface that is parallel to said main board, said planar surface having a plurality of perforations, each perforation having a perimeter and at least one elastic member projecting inside the perimeter of said each perforation, each switch being covered by a respective elastic member, each elastic member maintaining a gap between said each elastic member and said each switch;

a control button aligned linearly with a given elastic member and a given switch, said given elastic member being depressed and activating said given switch when said control button is depressed;

a guide frame abutting said structure and connectable with said frame, said guide frame having a perforation accommodating said control button; and a rubber bumper having a perforation for receiving said control button and abutting said guide frame, and being supported by a portion of said control button inserted through said perforation of said rubber bumper;

said control button being depressed and sliding through said perforation in said rubber bumper and said perforation in said guide frame to depress said given elastic member and to activate said given switch.

9. The electrical system of claim 8, said structure comprising:

a plurality of members protruding from a bottom of said four supporting sides and oriented perpendicularly to a major surface of said main board, said plurality of members having a latch for engaging said frame;

a plurality of flexible supports protruding from said bottom of said four supporting sides and oriented perpendicularly to a plane of said main board, said plurality of flexible supports abutting said frame and cooperating with said plurality of members to stabilize said structure; and a plurality of connectors positioned inside said four supporting sides to brace said main board.

10. The electrical system of claim 9, said latch on said plurality of members being disposed a first distance from a surface of said main board, said first distance being adjustable by moving said members through said frame and deforming said plurality of flexible supports.

11. The electrical system of claim 10, said at least one switch being disposed a second distance from said at least one elastic member, said second distance being set during assembly of the electric system;

said at least one elastic member being disposed a third distance from said control button, said third distance varying due to the occurrence of cyclical stresses; and said second distance and said third distance being changeable by adjusting said first distance.

12. An electrical system having a device covering a switch, said system comprising a main board supporting said switch, said main board being connected to a frame of said electrical system, said switch being activated by an external force;

said device covering said switch comprising a structure attached to said main board and including a supporting side and an elastic member, each said switch being covered by a single said elastic member, said elastic member maintaining a gap between said elastic member and said switch;

said system further comprising a guide frame abutting said structure and connectable with a front panel of said electrical system, said guide frame having a perforation accommodating a control button, and a rubber bumper abutting said guide frame and being supported by a portion of said control button that is inserted through a perforation in said rubber bumper;

said control button being depressed and sliding through said perforation in said rubber bumper and said perforation in said guide frame to depress said elastic member and activate said switch.

13. The electrical system of claim 12, said structure having a planar surface having a plurality of perforations, each said elastic member projecting inside a perimeter of a respective one of said plurality of perforations.

14. The electrical system of claim 12, said structure comprising:

a plurality of members protruding from a bottom of said supporting side and oriented perpendicularly to a plane of said main board, said plurality of members having a latch for engaging said frame;

a plurality of flexible supports protruding from said bottom of said supporting side and oriented perpendicularly to the plane of said main board, said plurality of flexible supports abutting said frame and cooperating with said plurality of members having said latches to stabilize said structure; and a plurality of connectors positioned inside said supporting side to brace said main board.

15. The electrical system of claim 12, said structure having four supporting sides.

16. The electrical system of claim 15, said structure comprising a planar surface bearing a first perforation and a second perforation, each having one elastic member, and a third perforation having four elastic members.

17. The electrical system of claim 12, further comprising a latch on a plurality of members disposed a first distance from a surface of said main board, said first distance being adjustable by moving said plurality of members through said frame and deforming said flexible supports.

18. The electrical system of claim 17, said switch being disposed a second distance from said elastic member, said second distance being set during assembly of the electrical system;

said elastic member being disposed a third distance from said control button, said third distance varying due to the occurrence of cyclical stresses; and said second distance and said third distance being changeable by adjusting said first distance.

19. A control apparatus for an electronic machine, said apparatus comprising:

a case having a knob hole and a guide latch;

a control knob inserted into said knob hole of said case and fixed to said guide latch, said control knob having a plurality of protrusions;

a frame;

a main board having a plurality of tactile switches;

a gap-maintaining member fixed to said frame and latched to said main board, and having a plurality of elastic tactile members located between said protrusions and said tactile switches;

wherein a gap is maintained between said elastic tactile members and said protrusions of said control knob.

20. The control apparatus of claim 19, further comprising a plurality of latch members formed on said gap-maintaining member and inserted into respective latch holes formed on said frame.

21. The control apparatus of claim 19, further comprising a plurality of board holders formed on said gap-maintaining member for connecting said main board to said gap-maintaining member.

22. The control apparatus of claim 19, wherein a gap is maintained between said tactile switches and said elastic tactile members.

23. The control apparatus of claim 19, wherein a gap is established between said frame and an end portion of a latch member formed on said gap-maintaining member when said latch member is inserted into a latch hole of said frame.

24. A control apparatus for an electronic machine, comprising:

a control knob having a plurality of protrusions;

a frame;

a main board having a plurality of tactile switches; and a gap-maintaining member fixed to said frame and to said main board, and having a plurality of elastic tactile members located between said protrusions and said tactile switches;

wherein said gap-maintaining member maintains a gap between said protrusions and said elastic tactile members.

25. The control apparatus of claim 24, wherein said gap-maintaining member maintains a gap between said elastic tactile members and said tactile switches.

26. The control apparatus of claim 24, further comprising a plurality of latch members formed on said gap-maintaining member and inserted into respective latch holes formed on said frame.

27. The control apparatus of claim 24, further comprising a plurality of board holders formed on said gap-maintaining member for connecting said main board to said gap-maintaining member.

28. The control apparatus of claim 24, further comprising a case having a knob hole for receiving said control knob, and a guide latch to which said control knob is fixed when said control knob is inserted into said knob hole.

29. The control apparatus of claim 24, wherein said gap-maintaining member has a latch member formed thereon, said latch member having an end portion, and wherein said gap-maintaining member establishes a gap between said frame and said end portion of said latch member.

30. The control apparatus of claim 29, wherein said gap-maintaining member maintains a gap between said elastic tactile members and said tactile switches.

* * * * *